United States Patent [19]

Furrier et al.

[11] 4,296,518

[45] Oct. 27, 1981

[54] TOOTHBRUSH AND GUM MASSAGING ACCESSORY

[75] Inventors: Joseph P. Furrier, Northvale; Allan H. Gilbert, Oradell, both of N.J.

[73] Assignee: Lever Brothers Company, New York, N.Y.

[21] Appl. No.: 99,343

[22] Filed: Nov. 30, 1979

[51] Int. Cl.[3] ..... A61H 13/00

[52] U.S. Cl. ..... 15/110; 128/62 A

[58] Field of Search ..... 15/110; 132/84 A, 84 C, 132/85, 89, 90, 93; 128/62 R, 62 A

[56] References Cited

U.S. PATENT DOCUMENTS

| | | | |
|---|---|---|---|
| 1,021,639 | 3/1912 | Smith | 132/84 C X |
| 1,487,075 | 3/1924 | Olson et al. | 128/62 A |
| 2,790,441 | 4/1957 | Oderman | 15/110 X |
| 2,800,899 | 7/1957 | Barron | 128/62 A |
| 2,888,008 | 5/1959 | Rosenthal | 15/110 X |

FOREIGN PATENT DOCUMENTS

| | | | |
|---|---|---|---|
| 284447 | 4/1931 | Italy | 132/84 A |

*Primary Examiner*—Edward L. Roberts
*Attorney, Agent, or Firm*—Philip Sands

[57] ABSTRACT

In a toothbrush including a handle and an array of bristles affixed to one end portion of the handle, as disclosed herein, is an improvement comprising a gum massaging accessory movably secured to an opposite end portion of the handle for articulation between a first position, stored and inoperative, in general alignment with the handle to an operative position askew to the handle.

4 Claims, 4 Drawing Figures

10
12
14
16
16A
16B
18
20
22
24
26
28
30
40
42
44
46
50
52
54
56
58
60

TOOTHBRUSH AND GUM MASSAGING ACCESSORY

BACKGROUND OF THE INVENTION

The present invention relates generally to the field of dental care, and more particularly to a toothbrush having a gum massaging accessory in the form, for example, of a pointed rubberized tip.

Toothbrushes with gum massaging accessories are conventional and well known. The construction generally involves the incorporation of a pointed rubberized tip at one end of the toothbrush. The rubberized tip extends generally perpendicular to the handle of the brush, and is constrained against movement relative to the handle. As such, users of the toothbrush who wish to store it in, for example, a ceramic-tile toothbrush holder or other toothbrush support on the bathroom wall often have difficulty inserting the rubberized tip through an opening in the holder, as the length of the rubberized tip at right angles to the handle is often greater than the maximum extent of the opening in the holder. The user, consequently, has to force the free end of the toothbrush and the rubberized tip through the opening, thereby making such toothbrushes somewhat undesirable for purchase and use.

Forcing a rubberized tip through an opening of a ceramic tile holder, additionally, eventually may lead to the abrasion of the pointed tip, thereby reducing its effectiveness as a gum massaging element. Moreover, debris may become embedded in the abraded pointed end of the rubberized tip, thereby making the gum massaging element or accessory less sanitary than it might otherwise be.

Also, when a toothbrush handle, which supports, in a conventional manner, the perpendicular and fixedly arranged rubberized tip, is held in the hand of a user, the rubberized tip often interferes with the comfort the user would otherwise have in gripping the free end of the toothbrush handle. A toothbrush that is uncomfortable to grip could lead to reduced brushing time, and as a consequence a reduced efficacy in tooth care.

SUMMARY OF THE INVENTION

Accordingly, it is an object of the present invention to provide a toothbrush with a gum massaging accessory which overcomes the disadvantages associated with conventional such accessories.

Particularly, it is an object of the present invention to provide a toothbrush with a gum massaging accessory which can be inserted into a wall-supported toothbrush holder loosely and without force.

In addition, it is an object of the present invention to secure a gum massaging element or accessory to a toothbrush handle so that it will not undergo abrasion when stored in a wall-supported toothbrush holder, and consequently it will not collect debris and become unsanitary. Furthermore, it is an object of the present invention to provide a toothbrush with a gum massaging element which will not at all interfere with the comfort of the user in gripping and using the toothbrush handle.

Accordingly, the present invention may be characterized as an improvement for a toothbrush which comprises a gum massaging accessory movably secured to a free end portion of the toothbrush handle for articulation between a first position in general alignment with the handle to at least a second position askew to the handle. In the first position, in general alignment with the handle, the gum massaging accessory is stored and inoperative such that the handle may be grasped by a user without interference, or inserted into an opening of a wall-supported toothbrush holder without force. In the second position of the gum massaging accessory, askew to the handle, the gum massaging accessory is operative and may be used as it is intended to for gum treatment.

BRIEF DESCRIPTION OF THE DRAWINGS

With the above and additional objects and advantages in view, the present invention may be better understood by referring to the drawings in which.

DETAILED DESCRIPTION OF THE INVENTION

Figures 1, 2, 3, 4:
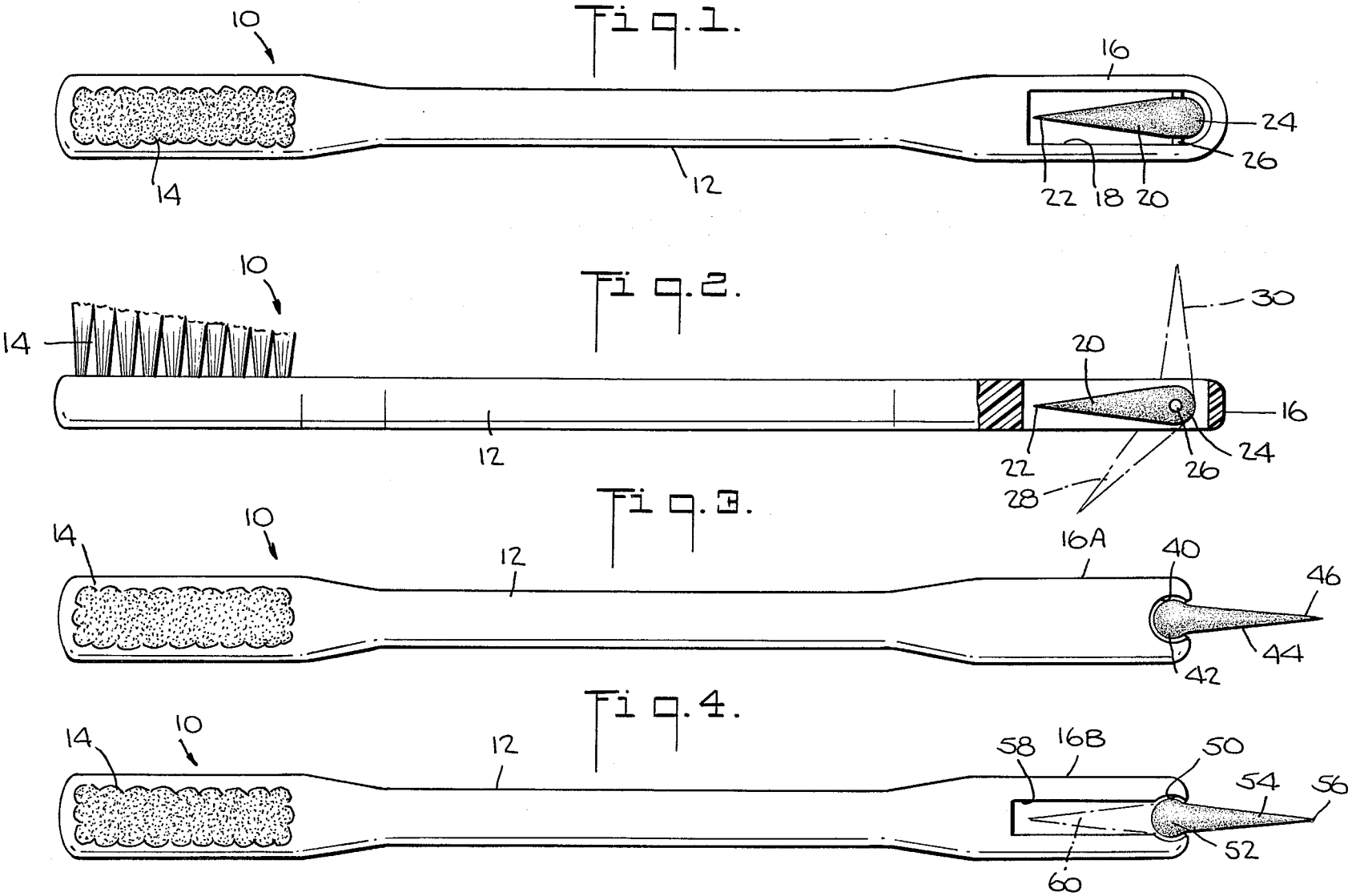
FIG. 1 is a top plan view illustrating the present invention in a stored, inoperative condition relative to a toothbrush handle.
FIG. 2 is a side elevational view, partially fragmented, illustrating in solid line the present invention in the condition of FIG. 1, as well as in phantom in an operative condition askew to the toothbrush handle.
FIG. 3 is a top plan view of an alternate embodiment of the present invention.
FIG. 4 is a top plan view of still another alternate embodiment of the present invention.

Referring now to the drawings, and more particularly FIGS. 1 and 2, the present invention involves a toothbrush denoted generally by the reference character 10. The toothbrush 10 includes a handle 12 at one end of which is presented a conventional array of bristles 14, for example, tapering from one end to the other. At the opposite end of the handle 12 is an improvement in the form of the present invention.

In this respect, in the preferred embodiment of the present invention, the handle 12 includes an end portion 16 in which is formed an elongate recess 18. In the recess 18, there is disposed a resilient or rubberized gum massaging element 20. The gum massaging element 20 is formed with a pointed end 22, for gum care, and a wider end portion 24 which is pivotally constrained frictionally in the recess 18 by means of, for example, a pin 26 or the like.

As illustrated in FIG. 1, the gum massaging element 20 is in a stored, inoperative condition in the recess 18, and remains there when the toothbrush 10 is used for brushing teeth or is stored in the opening of a toothbrush holder. For purposes of illustration, the handle 12 of the toothbrush 10 is partially fragmented at the end portion 16 to display the gum massaging element 20 (in solid line) in its stored, inoperative condition. However, as illustrated in broken line or phantom, and denoted by reference characters 28 and 30, the gum massaging element 20 can be turned out of the recess 18 into an operative condition for gum care purposes. In either of the positions denoted by reference characters 28 and 30, the pointed end 22 of the gum massaging element 20 can be used for gum treatment.

While the preferred embodiment of the present invention, as illustrated in FIGS. 1 and 2, has been discussed as having a recess 18 in which a pin 26 pivotally connects the gum massaging element 20 to the walls of the recess 18, other forms and variations of the present invention are contemplated. For example, an alternate embodiment of the present invention is illustrated in FIG. 3; however, for purposes of brevity, it will be understood that all reference characters appearing in FIG. 3 (as well as in FIG. 4 still to be discussed) which are identical to those reference characters presented in FIGS. 1 and 2 represent identical structure, and will not be discussed with regard to FIG. 3 (as well as with regard to Figure).

In FIG. 3 the right-hand end portion 16A is provided with a substantially spherical concavity 40 in which is secured a substantially spherical, mating end portion 42 of a gum massaging element 44 having a pointed end 46. In the embodiment of FIG. 3, the gum massaging element 44 can be turned relative to the concavity 40 into any position selected by a user over an arcuate range of, for example, 180°, beginning at right angles to the portion 16A on one side thereof and ending at right angles to the portion 16A on the other side thereof.

However, in order to store the gum massaging element 44 within the handle 12, to better protect it, the embodiment of FIG. 4 is also contemplated. In this regard, the toothbrush 10 is provided with an end portion 16B in which is formed a spherical concavity 50 which pivotally constrains a substantially spherical, mating end portion 52 of a gum massaging element 54 having a pointed end 56. What is provided in the embodiment of FIG. 4 in addition to that provided in FIG. 3 is an elongate recess 58 which communicates with the spherical recess 50. As a consequence, the pointed end 56 of the gum massaging element 54 can be turned selectively into an inoperative, stored condition in the handle 12. The stored condition of the gum massaging element 54 is shown in phantom and denoted by reference character 60. In this condition, the toothbrush handle can be manipulated comfortably and stored easily and sanitarily.

Having thus set forth the nature and characteristics of the present invention, it will be understood that still other embodiments and variations thereof may come to mind, and all such other embodiments and variations are considered part of the present invention if encompassed by the appended claims.

What is claimed is:

1. In a toothbrush including a handle and an array of bristles affixed to one end portion of said handle, an improvement comprising a gum massaging accessory movably secured to an opposite end portion of said handle for articulation between a first position in general alignment with said handle to at least a second position askew to said handle, said handle including a recess, said accessory including a resilient member terminating in a free-end portion for gum massaging treatment and an opposite end portion arranged in said recess, and pivot means for movably interconnecting said opposite end portion of said resilient member to said handle in said recess, said pivot means including a generally spherical-like socket, said free-end portion of said resilient member including a generally spherical-like region constrained in said socket for movement between said first and second positions.

2. The improvement as claimed in claim 1, wherein said recess is sufficiently large to accommodate the entire length of said resilient member in said first position of general alignment with said handle.

3. The improvement as claimed in claim 2, wherein said recess is open at two opposite ends to permit articulation of said resilient member from said first position in a stored inoperative condition to said second position at either side of said handle in an accessible operative condition.

4. The improvement as claimed in claim 2, wherein the maximum thickness of said resilient member is less than the minimum thickness of said handle at said recess such that no part of said resilient member when in said first position protrudes out of said recess.

* * * * *